US007413532B1

(12) United States Patent
Monsrud et al.

(10) Patent No.: US 7,413,532 B1
(45) Date of Patent: Aug. 19, 2008

(54) EXERCISE APPARATUS WITH INCREMENTAL WEIGHT STACK

(75) Inventors: Lon L. Monsrud, Andover, MN (US); Charles J. Rosenow, Ramsey, MN (US)

(73) Assignee: Brunswick Corporation, Lake Forest, IL (US)

( * ) Notice: Subject to any disclaimer, the term of this patent is extended or adjusted under 35 U.S.C. 154(b) by 874 days.

(21) Appl. No.: 10/831,744

(22) Filed: Apr. 23, 2004

(51) Int. Cl.
*A63B 21/062* (2006.01)

(52) U.S. Cl. ..... 482/99; 482/98

(58) Field of Classification Search ..... 482/92, 482/93, 94, 98, 99, 100, 101
See application file for complete search history.

(56) References Cited

U.S. PATENT DOCUMENTS 5,056,779 A 10/1991 Webb
5,104,121 A 4/1992 Webb
5,776,040 A * 7/1998 Webb et al. ..... 482/98
5,876,313 A * 3/1999 Krull ..... 482/98
6,719,672 B1 * 4/2004 Ellis et al. ..... 482/99
6,902,516 B2 * 6/2005 Krull ..... 482/98
2003/0092542 A1 * 5/2003 Bartholomew et al. ..... 482/99
2005/0176559 A1 * 8/2005 Carter ..... 482/94
2006/0205571 A1 * 9/2006 Krull ..... 482/94
2006/0217245 A1 * 9/2006 Golesh et al. ..... 482/94

* cited by examiner

*Primary Examiner*—Ehud Gartenberg
*Assistant Examiner*—Oren I Ginsberg
(74) *Attorney, Agent, or Firm*—Andrus, Sceales, Starke & Sawall, LLP

(57) ABSTRACT

Exercise apparatus has a weight stack for opposing a given exercise motion. The weight stack has a first set of a plurality of primary weights vertically stacked on each other, a primary weight selector having a plurality of settings selectively controlling the number of weights to be lifted during the exercise motion, a second set of a plurality of secondary weights, and a secondary weight selector having a plurality of settings selectively controlling the number of secondary weights to be lifted during the exercise motion, the secondary weights providing supplemental incremental weight.

21 Claims, 12 Drawing Sheets

EXERCISE APPARATUS WITH INCREMENTAL WEIGHT STACK

BACKGROUND AND SUMMARY

The invention relates to exercise apparatus, and more particularly to a weight stack for providing weight resistance resisting an exercise movement.

Various types of exercise apparatus providing various types of exercise movements are known in the prior art. A weight stack is commonly used for opposing a given exercise motion through a cable and pulley system.

The present invention provides exercise apparatus with a main or primary weight stack, and a secondary or incremental weight stack included for providing different weight settings at smaller increments between larger primary weights. The invention provides a simple user-friendly system.

DETAILED DESCRIPTION

Figure 1:
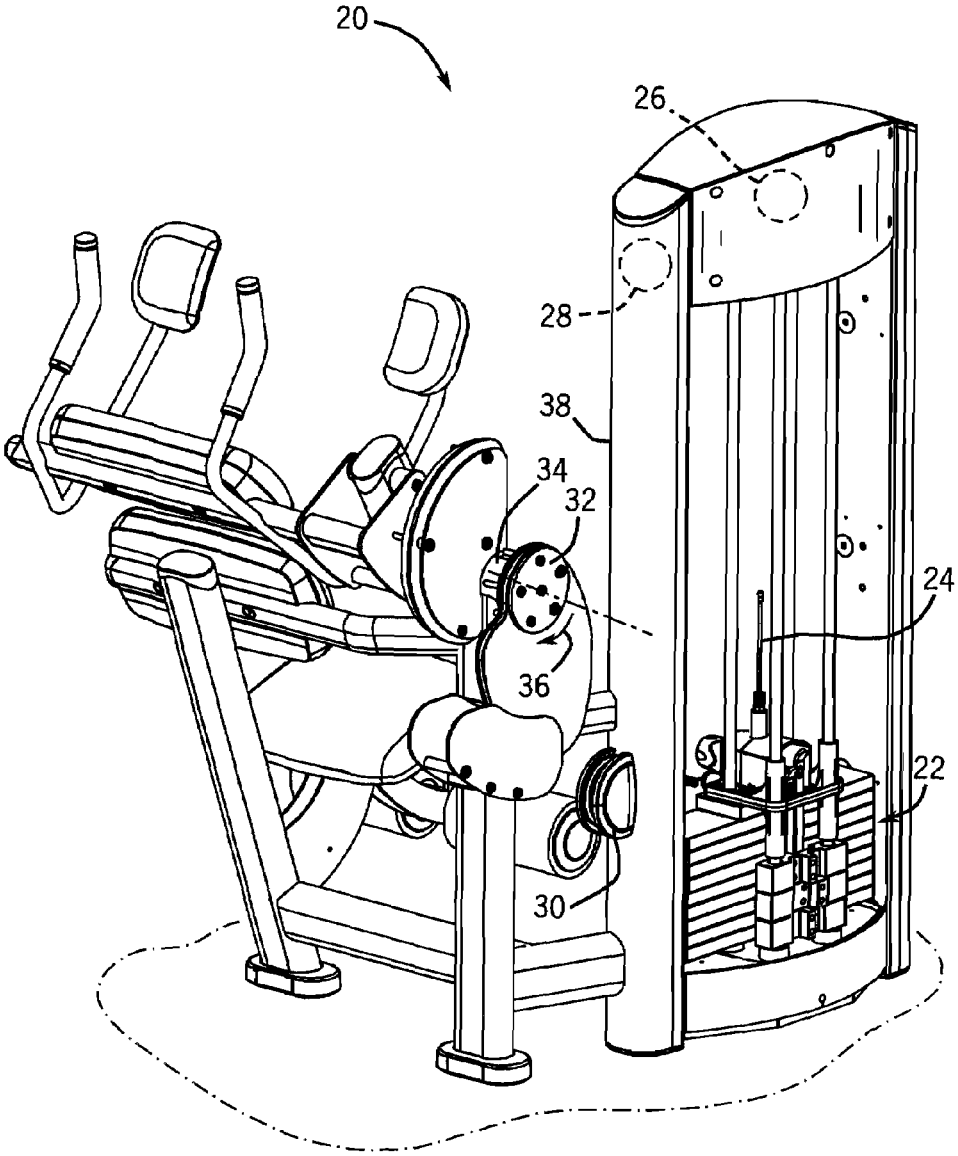
FIG. 1 is a perspective view of exercise apparatus in accordance with the invention.

FIGS. 1-4 show an exercise apparatus 20 including a weight stack 22 for opposing a given exercise motion through a cable and pulley system, e.g. cable 24 trained around pulleys 26, 28, 30 and connected to a retainer plate 32 on an axle or shaft 34 to resist rotation of such shaft along rotational directional arrow 36 which pulls the cable to lift a selected number of weights in the weight stack upwardly against the force of gravity. The exercise apparatus illustrated is an abdominal crunch machine having a frame 38 supporting a seat 40 upon which the user sits, a pair of foot/ankle restraints 42, 44, a stationary lower backrest 46, a movable upper backrest 48, handgrips 50, 52, and elbow rests 54, 56, for which further reference may be had to commonly owned co-pending U.S. patent application Ser. No. 10/831,395, filed Apr. 23, 2004, filed on even date herewith, though the present invention is applicable to other exercise apparatus using a weight stack for providing weight resistance resisting a given exercise movement. The disclosure of the present incremental weight stack with an abdominal crunch machine is exemplary only.

Figure 2:
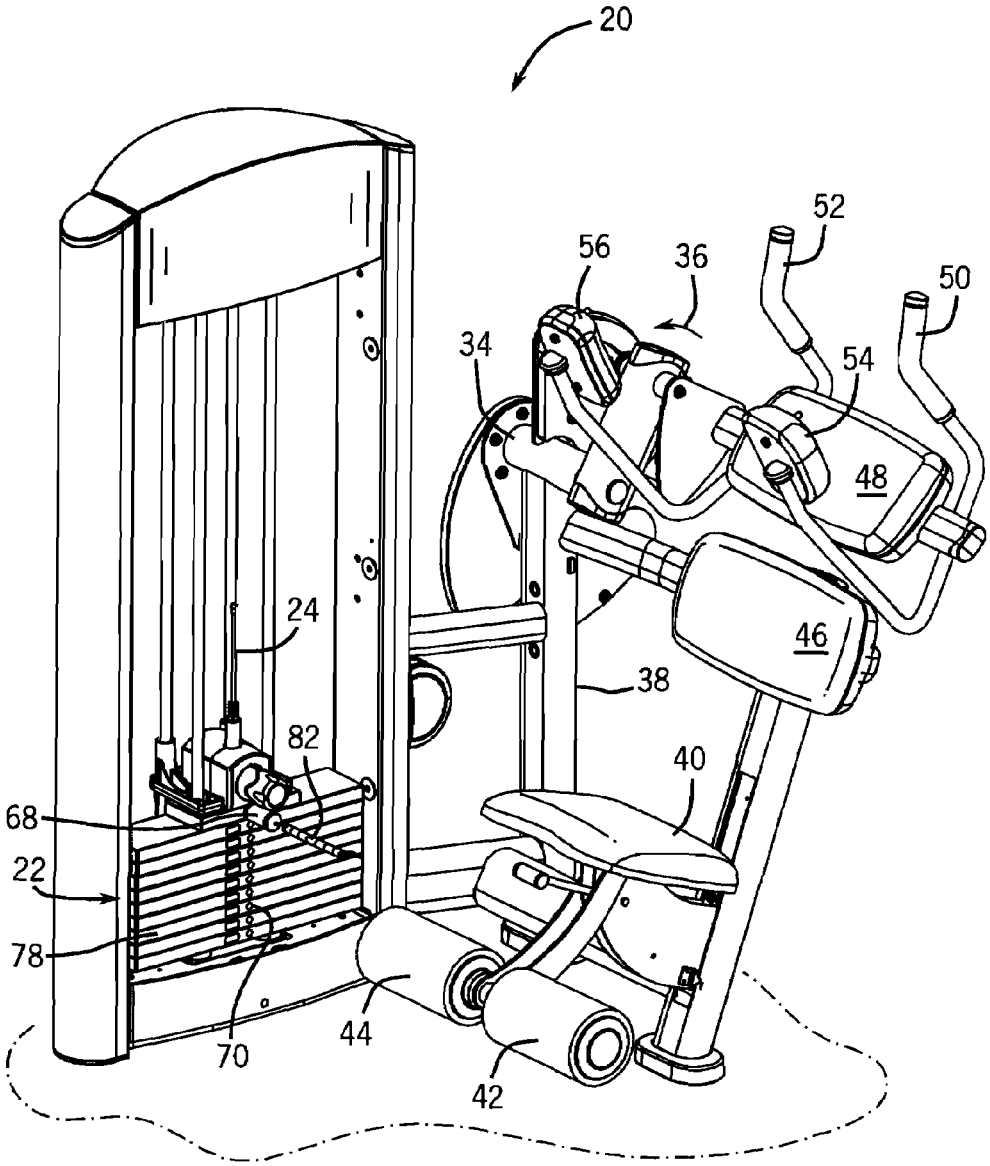
FIG. 2 is another perspective view of the apparatus of FIG. 1.
Figure 3:
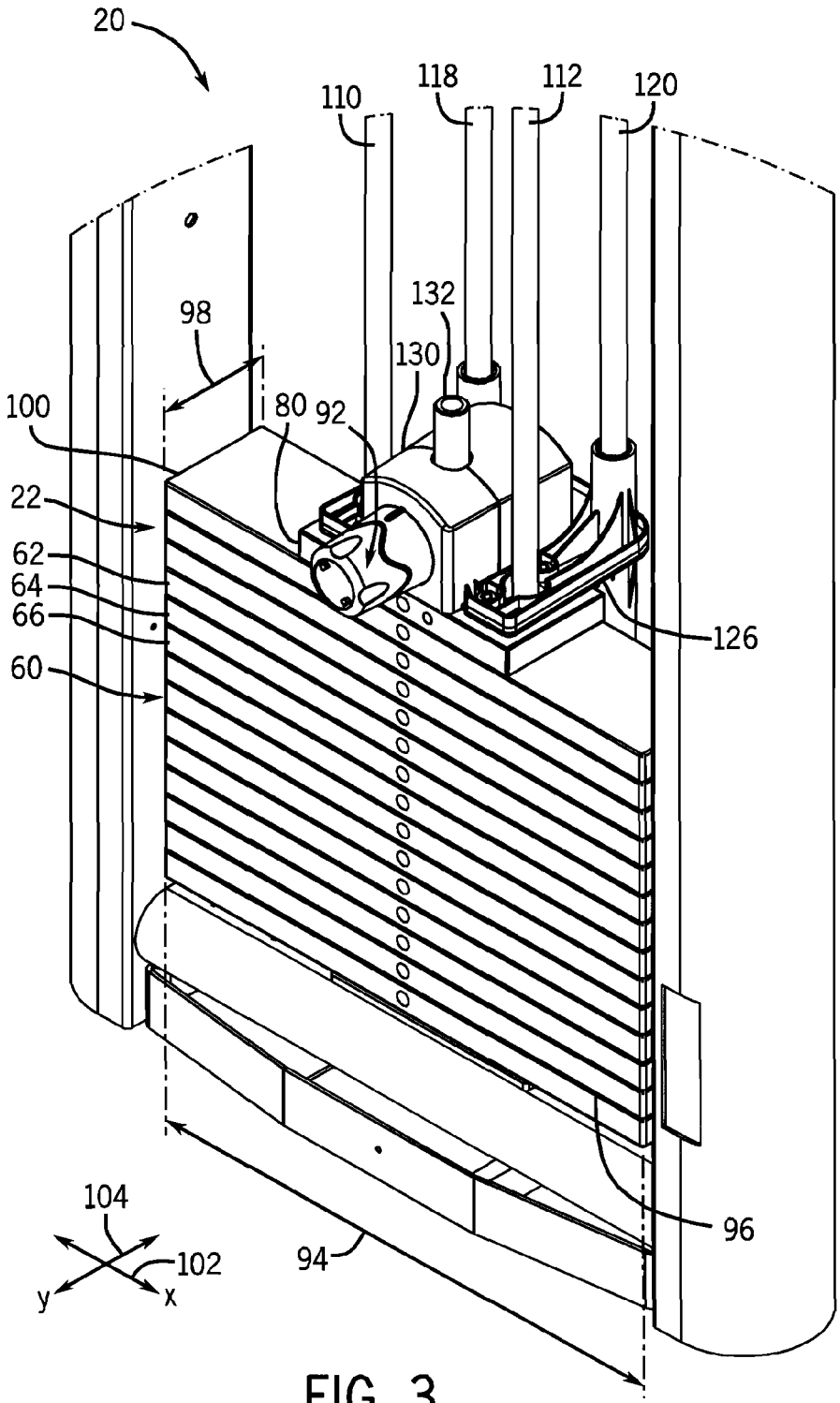
FIG. 3 is an enlarged view of a portion of FIG. 2.
Figure 4:
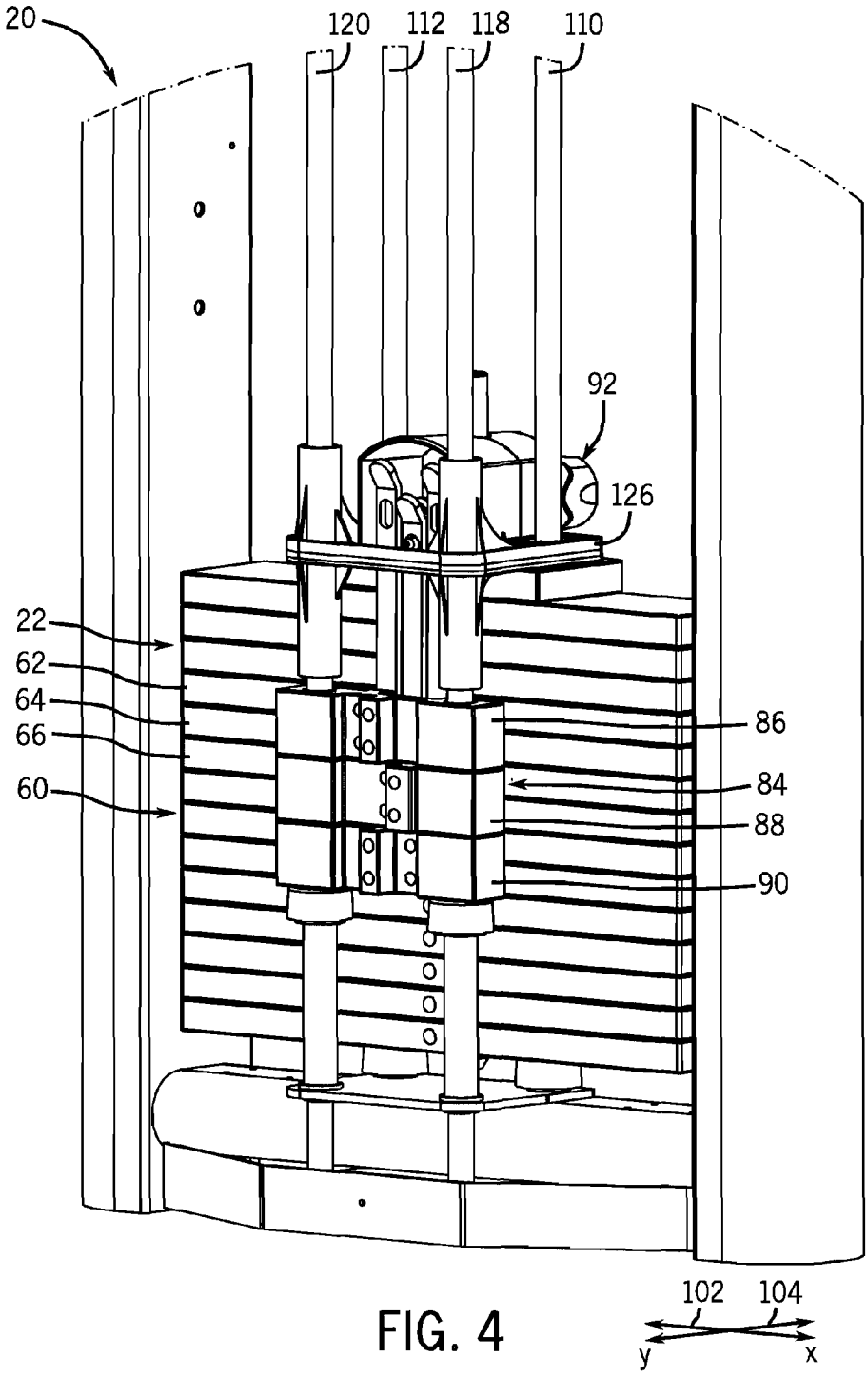
FIG. 4 is an enlarged view of a portion of FIG. 1.

Weight stack 22 has a first set 60, FIGS. 3, 4, of a plurality of primary weights 62, 64, 66, etc. vertically stacked on each other. A primary weight selector 68, FIG. 2, is provided in known manner by a peg or pin selectively insertable through an aperture 70, FIGS. 2, 14, in a selected weight such that the peg extends into a respective aperture 72, FIG. 10, in a shank 74 which extends vertically downwardly through vertically aligned central cut-outs or openings such as 76, FIG. 14, in weights 78, 62, 64, 66, etc., as is known, such that a selected weight such as 78 is pinned to shank 74 and pulled upwardly therewith by cable 24, which upward movement of weight 78 also lifts all of the weights thereabove, as is standard and known in the prior art. In the example shown, top weight 80 is 10 pounds, and each of the weights therebelow is 20 pounds. Top weight 80 is permanently affixed to shank 74. A different amount of lift weight may be selected by removing peg 68 from aperture 70 and inserting the peg in the aperture of a different weight. Peg 68 is typically connected by a lanyard 82, such as a coiled cord, to top weight 80 to prevent loss of the peg. The structure and operation described thus far is standard and known in the prior art.

In the present invention, a second set 84, FIG. 4, of a plurality of incremental or secondary weights 86, 88, 90 are provided. In the disclosed embodiment, each of secondary weights 86, 88, 90 is 5 pounds, to provide incremental weight differences between the larger 20 pound weight gaps between the weights of primary stack 60. A secondary weight selector 92, to be described, has a plurality of settings selectively controlling the number of secondary weights to be lifted by cable 24 during the exercise motion. The noted primary weights are vertically stacked on each other in first vertical stack 60. The noted secondary weights are vertically stacked on each other in second vertical stack 84. Second vertical stack 84 is laterally adjacent first vertical stack 60. The primary weights have a horizontal length 94, FIG. 3, along a longitudinal side 96, and have a horizontal width 98 along a lateral side 100. The horizontal length 94 is greater than the horizontal width 98. Secondary weights 86, 88, 90 in second vertical stack 84 are laterally adjacent primary weight 62, 64, 66, etc. in first vertical stack 60 along the longitudinal side 96 of the primary weights. Horizontal length 94 extends along a horizontal X-axis 102. Horizontal width 98 extends along a horizontal Y-axis 104. The center of mass of second vertical stack 84 is aligned with the center of mass of the first vertical stack 60 along Y-axis 104 rather than X-axis 102, to minimize the horizontal distance between the centers of mass of the first and second stacks 60 and 84. It is desirable that secondary weight stack 84 be along the side 96 of the primary weight stack 60, rather than along the end 100 of primary weight stack 60. This reduces friction and rubbing along the vertical guide rods, to be described, otherwise due to cantilever type lever arms or tilting caused by weight at a remote end of an arm or lever. Friction is further reduced by extended vertical guide surfaces along extended sleeves 250, 252, to be described, along respective vertical guide rods 118, 120, to be described.

Figure 14:
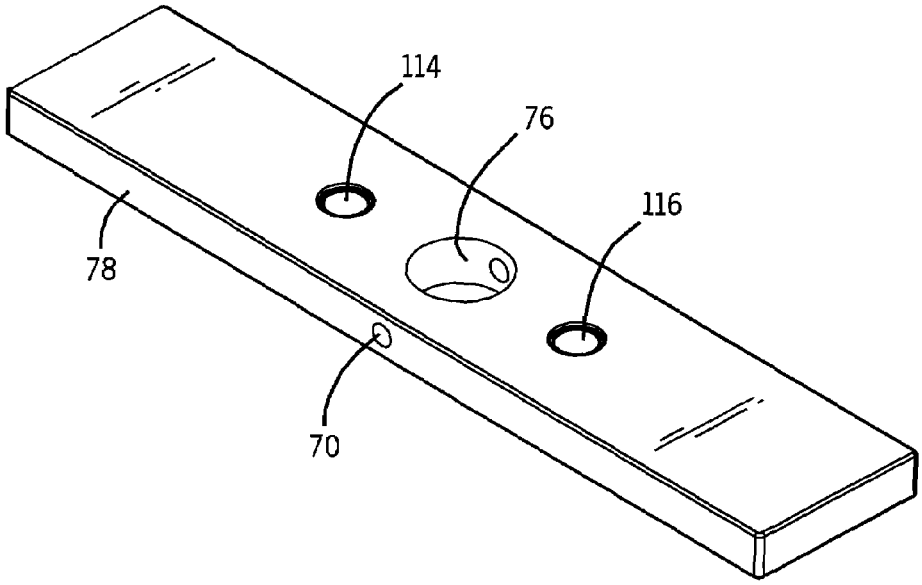
FIG. 14 is a perspective view of a component of FIG. 3.

The frame has a first set of vertical guide rods 110, 112 extending through respective apertures such as 114, 116, FIG. 14, in the primary weights such as 78 and captivating the primary weights and guiding and defining the vertical path of movement of the primary weights. The frame has a second set of vertical guide rods 118, 120 extending through respective apertures such as 122, 124, FIG. 6, of the secondary weights such as 86 and captivating the secondary weights and guiding and defining the vertical path of movement of the secondary weights. Secondary weight selector 92 includes a bridge plate 126, FIGS. 3-5, 9, 10, extending laterally from the primary weight stack and having an engagement member 128, FIGS. 9, 5, selectively engagable with the noted secondary weights such that the secondary weights are lifted by the bridge plate upon lifting of the primary weights by the cable. The bridge plate has an upper housing 130 and is attached to top weight 80 of the primary weight stack. Secondary weights 86, 88, 90 have respective vertical legs 134, 136, 138, FIGS. 5-8, extending upwardly adjacent first vertical stack 60, preferably on the opposite or backside thereof relative to the user. Legs 134, 136, 138 are selectively engagable by engagement member 128 and provide the noted plurality of settings of the noted secondary weight selector. Legs 134, 136, 138 have respective lower ends 140, 142, 144 attached to respective vertically stacked secondary weights 86, 88, 90 such that lifting of a given secondary weight by its respective leg also lifts any secondary weight thereabove. For example, lifting of secondary weight 88 by leg 136 also lifts secondary weight 86 but not secondary weight 90. In such example, a supplemental incremental weight of 10 pounds is added to the lift, namely 5 pound weight 86 and 5 pound weight 88. In this example, engagement member 128 selectively engages leg 136 and enables lifting of secondary weight 88 and secondary weight 86 thereabove without engagement by engagement member 128 of leg 134 of secondary weight 86.

Legs 134, 136, 138 are aligned along the noted X-axis 102. Bridge plate 126 has clearance apertures 150, 152 allowing clearance therethrough of rods 110, 112, respectively. Bridge plate 126 has guidance apertures 154, 156 respectively receiving vertical guide rods 118, 120 extending therethrough such that the bridge plate is captivated by the vertical guide rods 118, 120 and such that the vertical guide rods 118, 120 guide and define the vertical path of movement of bridge plate 126. The guided movement is enhanced by the noted vertically extended sleeves 250, 252, FIGS. 9, 10. Secondary weight selector 92 includes a user knob 158, FIG. 10, rotational about a rotation axis 160 between a plurality of settings. User knob 158 has a shaft 162, FIG. 9, extending axially therefrom along rotation axis 160 and journaled in housing 130 of the bridge plate. The end of shaft 162 opposite knob 158 has an arm 164 fixed thereto and extending radially therefrom to the noted engagement member 128 provided by a pin radially offset from shaft 162 and defining an arc about rotation axis 160 upon rotation of user knob 158. Engagement pin 128 extends axially and selectively engages the noted legs 134, 136, 138 by extending axially into respective apertures 166, 168, 170. Engagement pin 128 engages different legs during movement of the engagement pin along the noted arc during rotation of knob 158.

Figure 5:
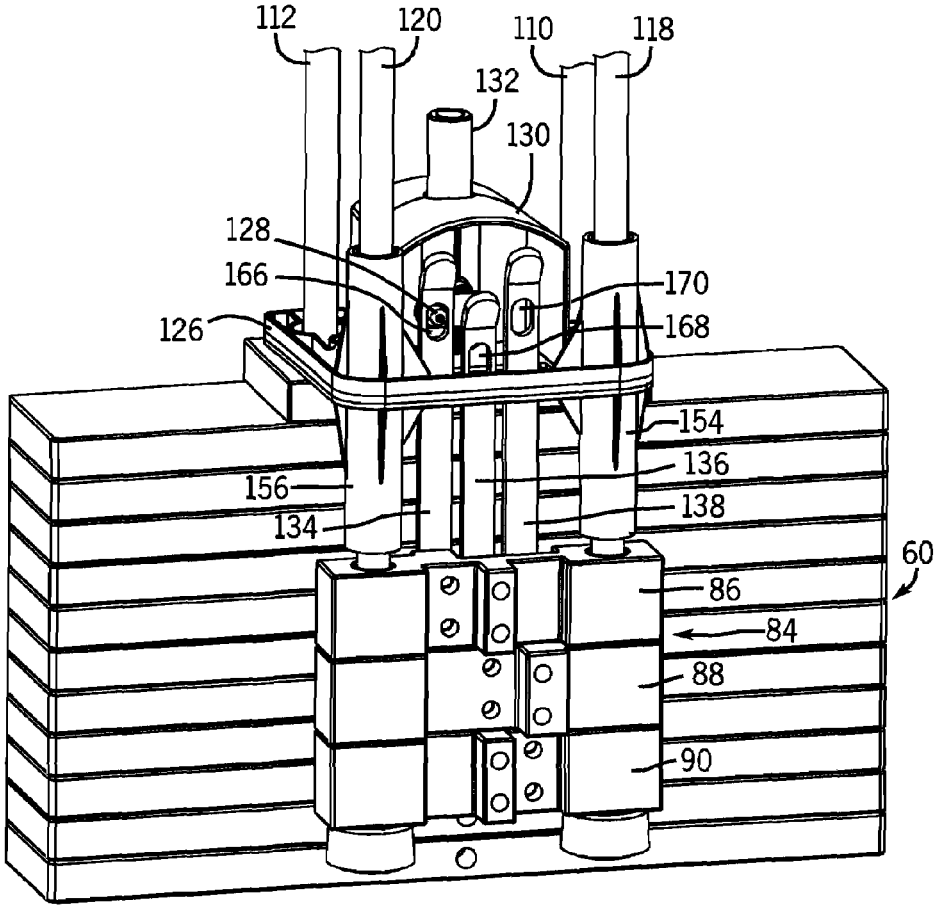
FIG. 5 is an enlarged view of a portion of FIG. 4.
Figure 6:
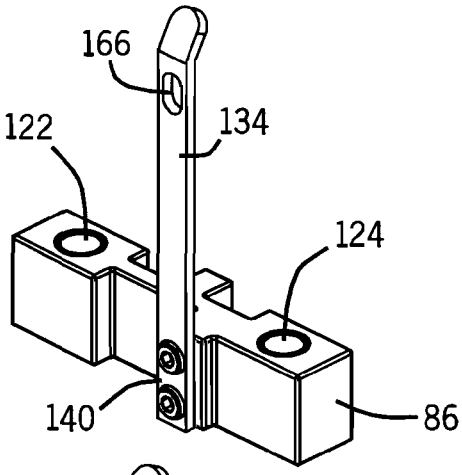
FIG. 6 is a perspective view of a component of FIG. 4.
Figure 7:
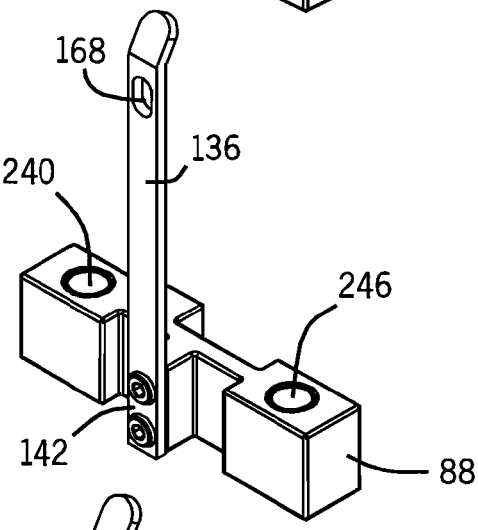
FIG. 7 is a perspective view of another component of FIG. 4.
Figure 8:
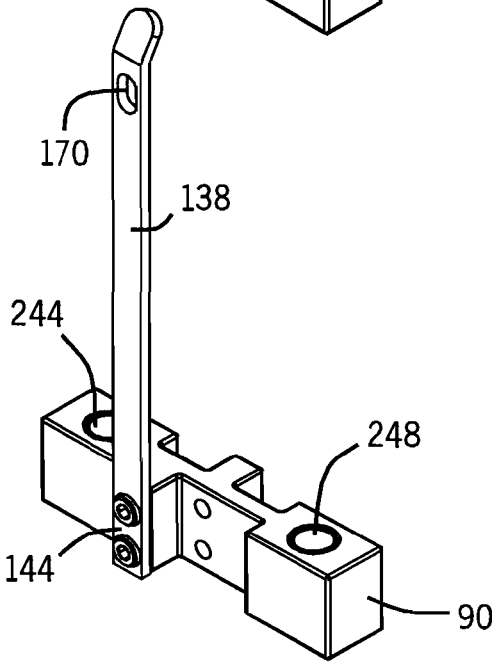
FIG. 8 is a perspective view of another component of FIG. 4.

User knob 158 has a plurality of clockface positions including a 3 o'clock position 172 wherein engagement pin 128 engages the leg of a first of the secondary weights, for example as shown in FIG. 5 where pin 128 engages leg 134 at aperture 166. The knob has a 6 o'clock position 174 wherein engagement pin 128 engages the leg of a second of the secondary weights, for example in the position shown in FIG. 9 the engagement pin 128 would engage leg 136 by extending through aperture 168. The knob has a 9 o'clock position 176 wherein engagement pin 128 engages the leg of a third of the secondary weights, for example aperture 170 of leg 138 of secondary weight 90. The knob has a 12 o'clock position 178 wherein engagement pin 128 would be in an upper position, distally opposite to that shown in FIG. 9, and would engage none of the legs of the secondary weights. In the noted 12 o'clock position, no supplemental incremental weight is added to the lift, i.e., upon lifting of one or more or none of the primary weights in first stack 60 by shank 74 and cable 24, none of the secondary weights in second stack 84 are lifted. In the noted 3 o'clock position of knob 158, 5 pound supplemental incremental weight is added to the lift because secondary weight 86 is lifted by bridge plate 126 as cable 24 is pulled upwardly. In the noted 6 o'clock position, 10 pound supplemental incremental weight is added to the lift because secondary weights 88 and 86 are additionally lifted. In the noted 9 o'clock position, 15 pound supplemental incremental weight is added to the lift because secondary weights 90, 88, 86 are additionally lifted.

User knob 158 and shaft 162 attached thereto are also axially translatable along rotation axis 160, FIGS. 9-12, to move engagement pin 128 axially into and out of engagement with a respective leg, i.e., into and out of engagement axially through respective apertures 166, 168, 170 in respective legs 134, 136, 138. Secondary weight selector 92 is changed between the plurality of settings 172, 174, 176, 178 at the noted respective 3 o'clock, 6 o'clock, 9 o'clock, 12 o'clock positions by axially translating user knob 158 in a first axial direction 180, e.g., leftwardly in FIGS. 10-12, along rotation axis 160 from a first axial position, FIG. 10, to a second axial position, FIG. 12, then rotating user knob 158 as shown at rotational arrow 182, e.g., clockwise in FIGS. 10-12, about rotation axis 160 from a first rotational position, e.g., at 3 o'clock, to a second rotational position, e.g., at 6 o'clock, etc., then axially translating knob 158 in a second axial direction 184 along rotation axis 160 from the noted second axial position, FIGS. 11, 12, to the noted first axial position, FIG. 10. The noted second axial direction 184 is opposite to the noted first axial direction 180. Engagement pin 128 in the noted first axial position, in the noted 3 o'clock, 6 o'clock and 9 o'clock positions, engages a respective selected aperture 166, 168, 170 of a respective selected leg 134, 136, 138 of a respective selected secondary weight 86, 88, 90. Engagement pin 128 in the noted second axial position disengages apertures 166, 168, 170 of legs 134, 136, 138. A biasing member is provided by a compression spring 186, FIG. 9, biasing shaft 162 and arm 164 leftwardly in FIG. 9 and hence biasing user knob 158 to the noted first axial position. Secondary weight selector 92 is thus preferably provided by a push-pull user knob assembly rotational about rotation axis 160 between the noted plurality of settings and axially translatable along rotation axis 160 in push-pull opposite axial directions to engage and disengage a selected secondary weight at its respective leg 134, 136, 138.

Figure 10:
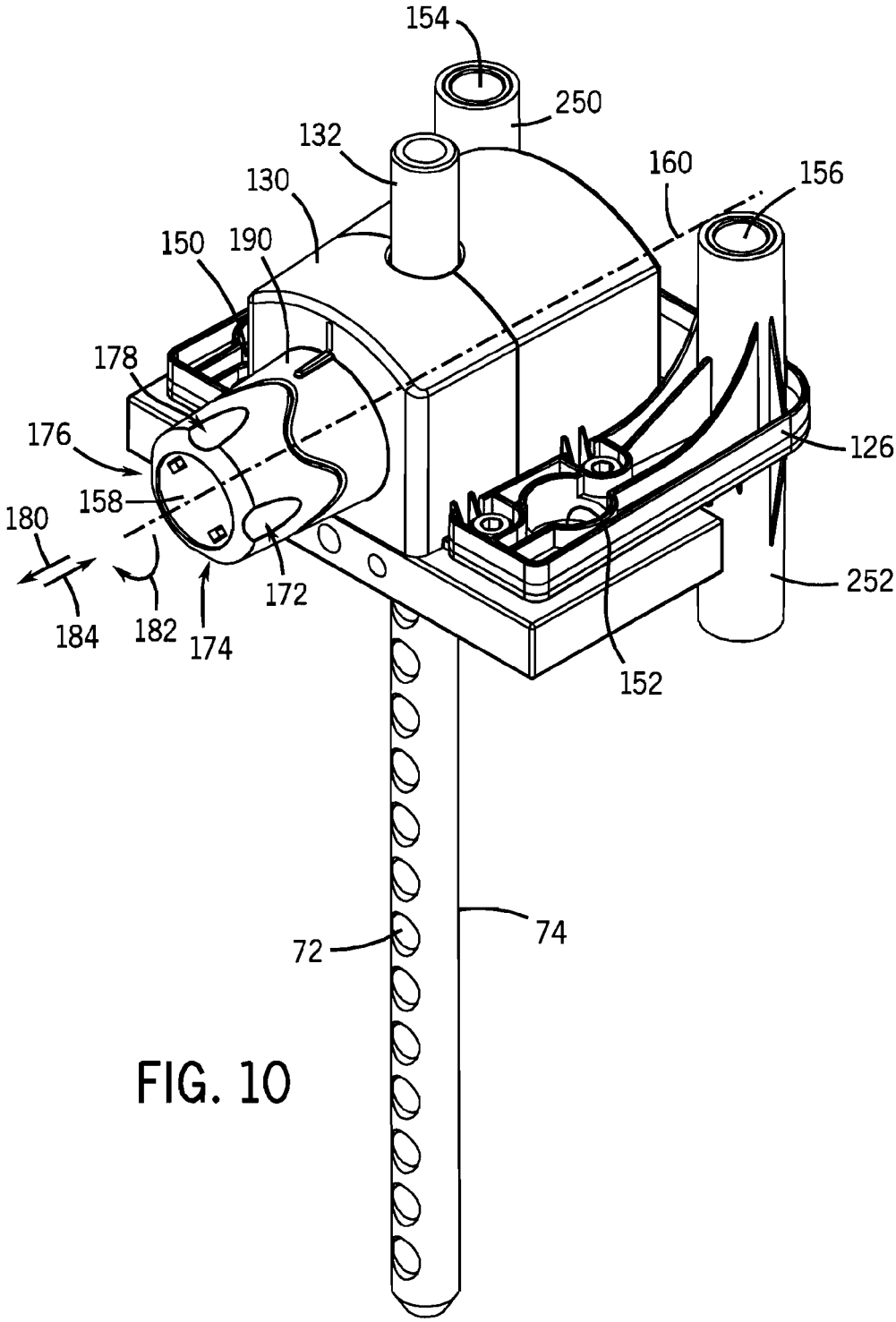
FIG. 10 is another perspective view of the component of FIG. 9.
Figure 11:
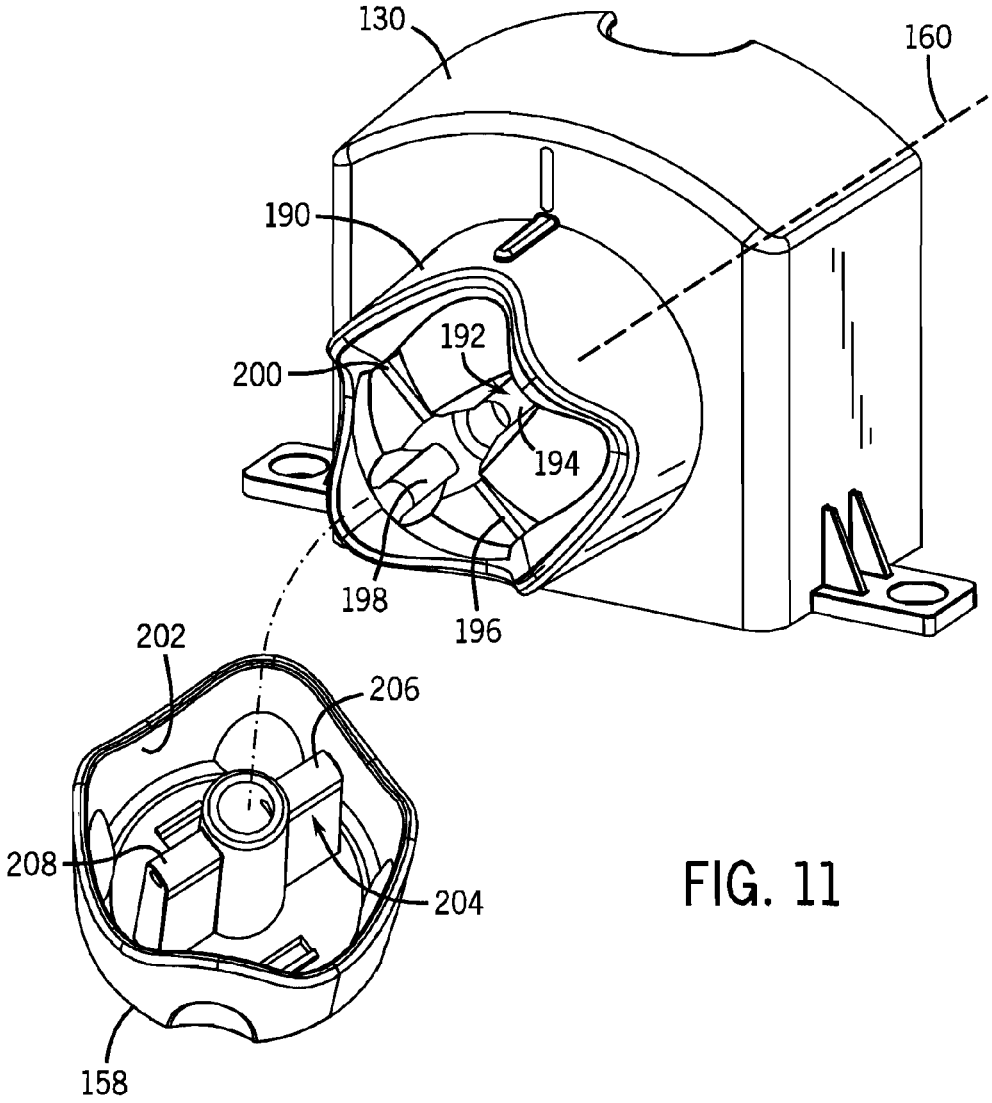
FIG. 11 is an exploded perspective view of a portion of FIG. 10.
Figure 12:
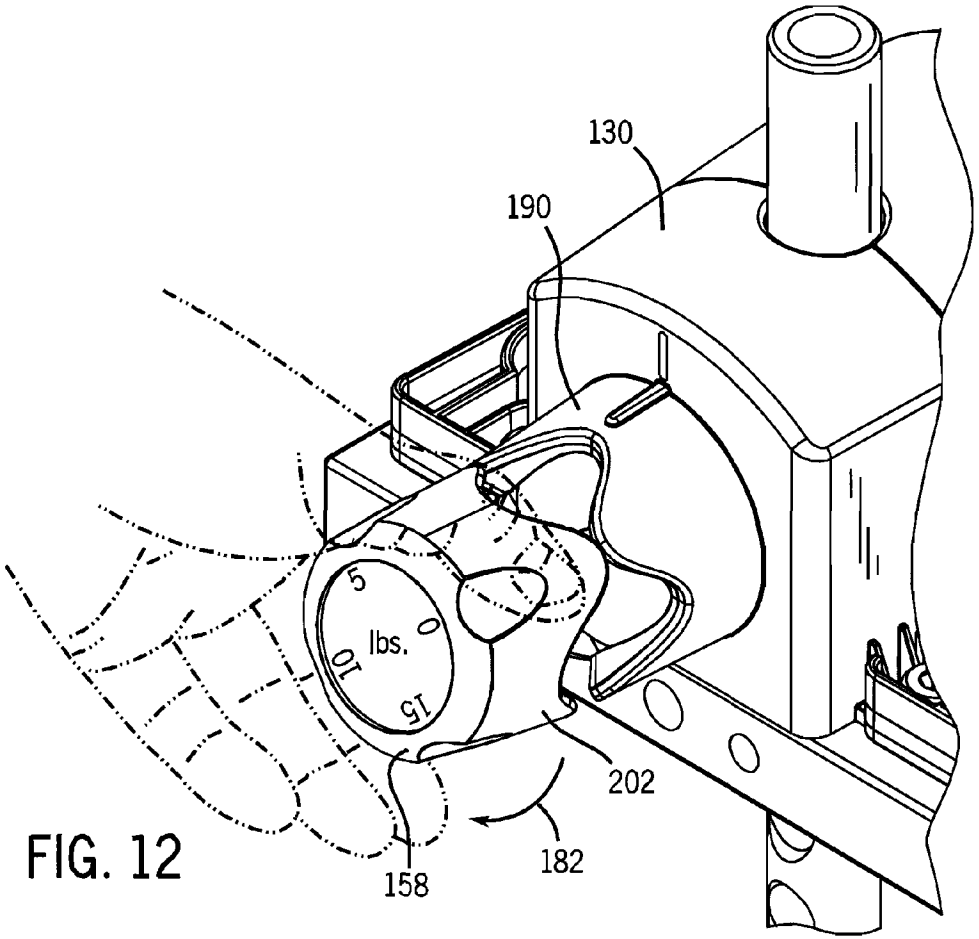
FIG. 12 is an enlarged perspective view of a portion of FIG. 10 illustrating operation.

The push-pull user knob assembly is mounted to first weight stack 60 by bridge plate 126 at housing 130 having a yoke 190, FIGS. 10-12, receiving the user knob assembly in push-pull relation. The yoke 190 has a detent 192, FIG. 11, provided by a plurality of slots, for example four slots 194, 196, 198, 200 extending radially relative to rotation axis 160 and circumferentially spaced around rotation axis 160, for example in a cross-shape. User knob 158 has a collar 202 having a detent 204 provided by one or more ribs such as 206, 208 matingly engaging a respective one of the noted slots in the noted first axial position of the user knob, FIG. 10, and axially withdrawn from the respective slot in the noted second axial position of the user knob, FIG. 12. User knob 158 is axially translatable along rotation axis 160 in axial direction 184, FIG. 10, to the noted first axial position wherein the first and second detents 192 and 204 engage in indexed nested relation, to index the user knob assembly to a given rotational position corresponding to one of the noted settings. The user knob assembly is axially translatable along rotation axis 160 in axial direction 180 to the noted second axial position axially separating the first and second detents to permit rotation of the user knob assembly, e.g., at 182, about rotation axis 160 to a different setting. The user knob assembly is thus indexed to a given rotational position corresponding to one of the noted settings, e.g., 3 o'clock or 6 o'clock or 9 o'clock or 12 o'clock, and is axially translatable along rotation axis 160 to a released position permitting rotation of the user knob assembly about rotation axis 160 to a different one of the noted settings. Biasing spring 186 biases the user knob assembly to the noted first axial position to maintain collar 202 on yoke 190 in indexed nested relation, FIG. 10.

Figure 9:
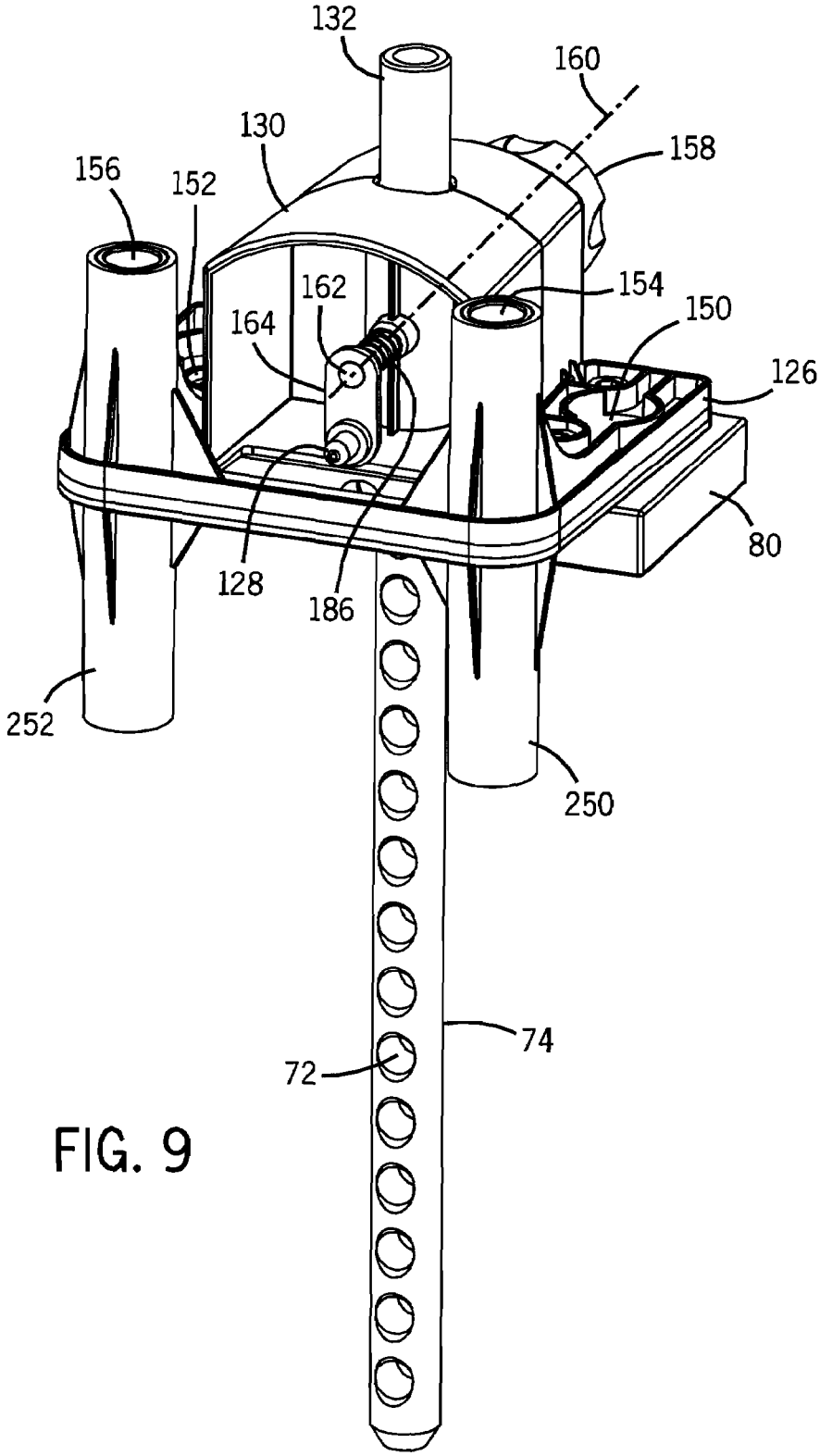
FIG. 9 is a perspective view of another component of FIG. 4.
Figure 13:
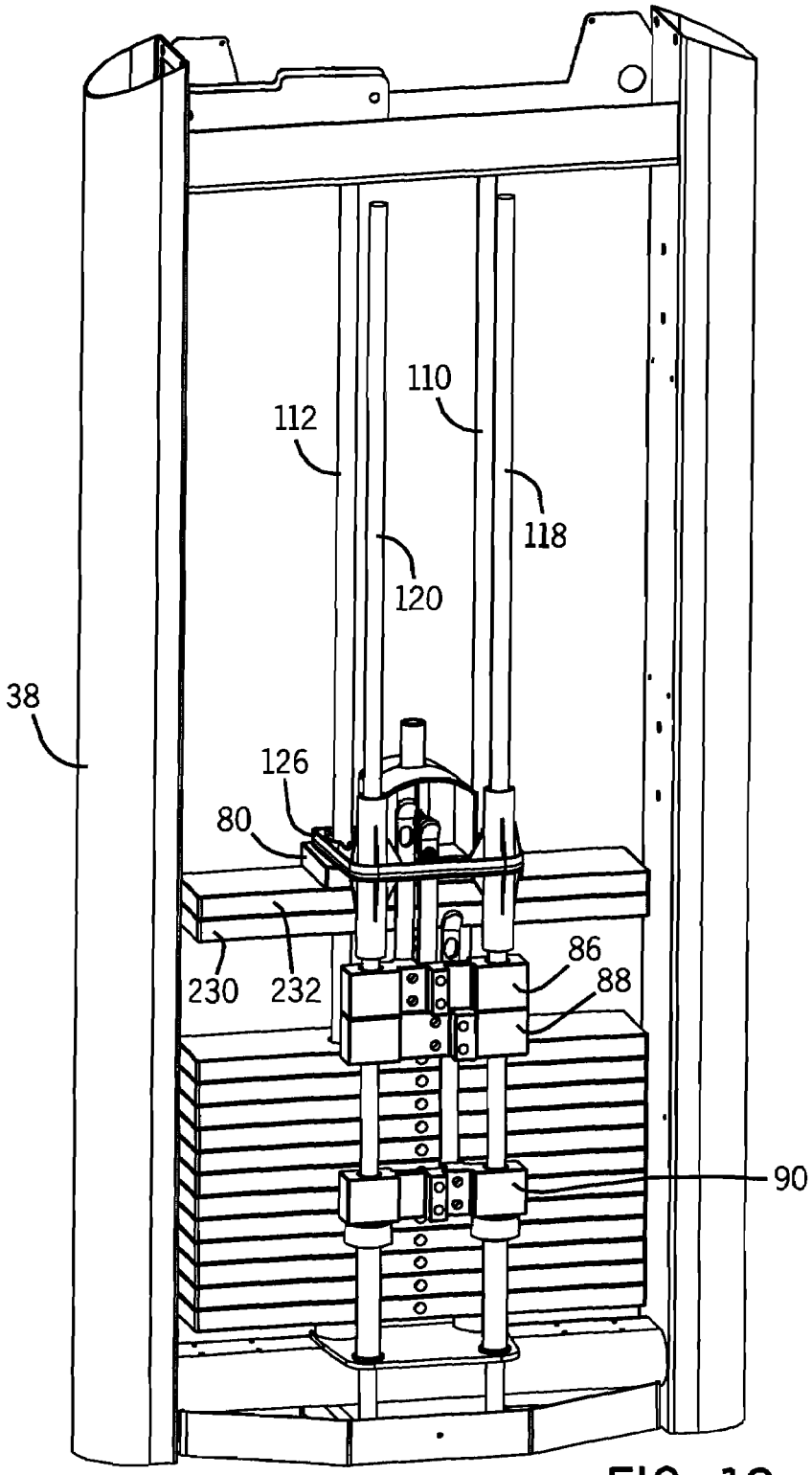
FIG. 13 is a perspective view of a portion of FIG. 1 illustrating operation.

FIG. 13 shows an operational position of the exercise apparatus, including a 60 pound lift. Peg 68 of the primary weight selector is inserted into aperture 70 of primary weight 230 such that upon upward movement of pulley 24 the shank 74 lifts primary weight 230 and primary weight 232 and primary weight 80 upwardly, thus providing a lift weight from the primary weight stack of 50 pounds, namely the 20 pounds of primary weight 230 plus the 20 pounds of primary weight 232 plus the 10 pounds of primary weight 80. These primary weights are guided during their upward movement by and are captivated by vertical guide rods 110 and 112. In addition, a supplemental incremental lift weight of 10 pounds is provided by secondary weight 88 and secondary weight 86 being lifted by bridge plate 126 on top primary weight 80. User knob 158 of secondary weight selector 92 is in the noted 6 o'clock position whereby engagement pin 128 is in its lower position as shown in FIG. 9 and extends axially through aperture 168 and engages leg 136 to thus lift secondary weight 88 and secondary weight 86 thereabove upon upward movement of the bridge plate as pulled by cable 24. Thus, the total lift weight is 60 pounds, namely 50 pounds provided by the weights lifted from the primary stack, and 10 pounds provided by the weights lifted from the secondary stack. In the noted 6 o'clock position, the 10 pound designation on the dial face of the user knob, FIG. 12, is in the upper position, and the 0 pound indicator is in the lower position distally opposite therefrom. In the noted 3 o'clock position, the 5 pound indicator is in the upper position. In the noted 9 o'clock position, the 15 pound indicator is in the upper position. In the noted 12 o'clock position, the 0 pound indicator is in the upper position. During upward movement of the cable, the selected secondary weights are captivated and guided along vertical guide rods 118 and 120. Guide rod 118 extends vertically through respective apertures 122, 240, 244 of secondary weights 86, 88, 90, FIGS. 6-8. Vertical guide rod 120 extends vertically through respective apertures 124, 246, 248 of secondary weights 86, 88, 90, respectively. Bridge plate 126 is captivated by and guided along vertical guide rods 118, 120 extending vertically through respective openings 154, 156. In preferred form, openings 154 and 156 are provided through vertically extended respective sleeves 250 and 252 for vertically elongated guidance and stability and reduced friction of the bridge plate along the guide rods.

It is recognized that various equivalents, alternatives and modifications are possible within the scope of the appended claims.

What is claimed is:

1. Exercise apparatus comprising a weight stack for opposing a given exercise motion through a cable and pulley system, said weight stack comprising a first set of a plurality of primary weights vertically stacked on each other, a primary weight selector having a plurality of settings selectively controlling the number of primary weights to be lifted by said cable during said exercise motion, a second set of a plurality of secondary weights, a secondary weight selector having a plurality of settings selectively controlling the number of said secondary weights to be lifted by said cable during said exercise motion; said primary weights are vertically stacked on each other in a first vertical stack, and said secondary weights are vertically stacked on each other in a second vertical stack; said secondary weight selector comprises a bridge plate extending laterally from said first vertical stack and having an engagement member selectively engagable with said secondary weights such that said secondary weights are lifted by said bridge plate upon lifting of said primary weights by said cable; said secondary weights have respective vertical legs extending upwardly adjacent said first vertical stack, said legs being selectively engagable by said engagement member of said bridge plate and providing said plurality of settings of said secondary weight selector.

2. The exercise apparatus according to claim 1 wherein said second vertical stack is laterally adjacent said first vertical stack.

3. The exercise apparatus according to claim 2 wherein said primary weights have a horizontal length along a longitudinal side, and a horizontal width along a lateral side, said horizontal length being greater than said horizontal width, and wherein said secondary weights in said second vertical stack are laterally adjacent said primary weights in said first vertical stack along said longitudinal side of said primary weights.

4. The exercise apparatus according to claim 3 wherein said horizontal length extends along a horizontal X-axis, said horizontal width extends along a horizontal Y-axis, said second vertical stack has a center of mass aligned with the center of mass of said first vertical stack along said Y-axis rather than said X-axis, to minimize the horizontal distance between the centers of mass of said first and second stacks.

5. The exercise apparatus according to claim 1 comprising a first set of one or more guide members guiding the vertical path of movement of said primary weights, and a second set of one or more guide members guiding the vertical path of movement of said secondary weights.

6. The exercise apparatus according to claim 5 wherein said first set of one or more guide members comprises one or more vertical guide rods captivating said primary weights and guiding and defining the vertical path of movement of said primary weights, and said second set of guide members comprises one or more vertical guide rods captivating said secondary weights and guiding and defining the vertical path of movement of said secondary weights.

7. The exercise apparatus according to claim 1 wherein said legs have lower ends attached to respective vertically stacked said secondary weights such that lifting of a first secondary weight by its respective leg also lifts a second secondary weight thereabove.

8. The exercise apparatus according to claim 7 wherein selective engagement of said leg of said first secondary weight by said engagement member enables said lifting of said first secondary weight and said second secondary weight thereabove without engagement by said engagement member of the leg of said second secondary weight.

9. The exercise apparatus according to claim 1 wherein said primary weights have a horizontal length along a longitudinal side, and a horizontal width along a lateral side, said horizontal length being greater than said horizontal width, and wherein said secondary weights in said second vertical stack are laterally adjacent said primary weights in said first vertical stack along said longitudinal side of said primary weights, and wherein said horizontal length extends along a horizontal X-axis, said horizontal width extends along a horizontal Y-axis, and wherein said legs of said secondary weights are aligned along said X-axis.

10. The exercise apparatus according to claim 1 comprising a first set of one or more vertical guide rods captivating said primary weights and guiding and defining the vertical path of movement of said primary weights, a second set of one or more vertical guide rods captivating said secondary weights and guiding and defining the vertical path of movement of said secondary weights, and wherein said bridge plate is captivated by said second set of vertical guide rods, and wherein said second set of vertical guide rods guides and defines the vertical path of movement of said bridge plate.

11. The exercise apparatus according to claim 1 wherein said secondary weight selector comprises a user knob rotational about a rotation axis between said plurality of settings, said user knob having a shaft extending axially therefrom along said rotation axis and journaled in said bridge plate, said shaft having an engagement pin radially offset therefrom and defining an arc about said rotation axis upon rotation of said user knob, said engagement pin providing said engagement member and engaging different of said legs during movement of said engagement pin along said arc during said rotation of said user knob.

12. The exercise apparatus according to claim 11 wherein said user knob has a plurality of clockface positions comprising a 3 o'clock position wherein said engagement pin engages the leg of a first of said secondary weights, a 6 o'clock position wherein said engagement pin engages the leg of a second of said secondary weights, a 9 o'clock position wherein said engagement pin engages the leg of a third of said secondary weights, and a 12 o'clock position wherein said engagement pin engages none of the legs of said secondary weights.

13. The exercise apparatus according to claim 11 wherein said user knob and said shaft are also axially translatable along said rotation axis to move said engagement pin into and out of engagement with a respective said leg.

14. The exercise apparatus according to claim 13 wherein said secondary weight selector is changed between said plurality of settings by axially translating said user knob in a first axial direction along said rotation axis from a first axial position to a second axial position, rotating said user knob about said rotation axis from a first rotational position to a second rotational position, axially translating said user knob in a second axial direction along said rotation axis from said second axial position to said first axial position, said second axial direction being opposite to said first axial direction, said engagement pin in said first axial position engaging a respective selected leg of a selected secondary weight, said engagement pin in said second axial position disengaging said selected leg.

15. The exercise apparatus according to claim 14 comprising a biasing member biasing said user knob to said first axial position.

16. The exercise apparatus according to claim 1 wherein said secondary weight selector comprises a push-pull user knob assembly rotational about a rotation axis between said plurality of settings and axially translatable along said rotation axis in push-pull opposite axial directions to engage and disengage a selected secondary weight.

17. The exercise apparatus according to claim 16 wherein said user knob assembly is mounted to said first weight stack by a bridge plate having a yoke receiving said user knob assembly in push-pull relation, said yoke having a first detent, said user knob assembly comprises a user knob having a collar having a second detent, said user knob assembly being axially translatable along said rotation axis to a first axial position wherein said first and second detents engage in indexed nested relation, to index said user knob assembly to a given rotational position corresponding to one of said settings, said user knob assembly being axially translatable along said rotation axis to a second axial position axially separating said first and second detents to permit rotation of said user knob assembly about said rotation axis to a different of said settings.

18. The exercise apparatus according to claim 17 wherein one of said first and second detents comprises one or more slots, and the other of said first and second detents comprises one or more ribs matingly engaging a respective one of said slots in said first axial position of said user knob assembly and axially withdrawn from said slot in said second axial position of said user knob assembly.

19. The exercise apparatus according to claim 18 wherein said one or more slots extend radially relative to said rotation axis, and said one or more ribs extend radially relative to said rotation axis.

20. The exercise apparatus according to claim 19 comprising a plurality of radially extending said slots circumferentially spaced around said rotation axis.

21. The exercise apparatus according to claim 17 comprising a biasing member biasing said user knob assembly to said first axial position to maintain said collar on said yoke in indexed nested relation.

* * * * *